US007513447B2

(12) United States Patent
Lee

(10) Patent No.: US 7,513,447 B2
(45) Date of Patent: Apr. 7, 2009

(54) MULLER

(75) Inventor: Kwang-Jae Lee, Seoul (KR)

(73) Assignee: Nano Korea Company, Ltd., Gyeonggi-Do (KR)

( * ) Notice: Subject to any disclaimer, the term of this patent is extended or adjusted under 35 U.S.C. 154(b) by 567 days.

(21) Appl. No.: 10/554,029

(22) PCT Filed: Apr. 20, 2004

(86) PCT No.: PCT/KR2004/000896

§ 371 (c)(1),
(2), (4) Date: Oct. 20, 2005

(87) PCT Pub. No.: WO2004/094064

PCT Pub. Date: Nov. 4, 2004

(65) Prior Publication Data

US 2006/0208113 A1 Sep. 21, 2006

(30) Foreign Application Priority Data

Apr. 21, 2003 (KR) ..... 10-2003-0025055

(51) Int. Cl.

| | |
|---|---|
| ***B02B 1/00*** | (2006.01) |
| ***B02B 5/02*** | (2006.01) |
| ***B02C 11/08*** | (2006.01) |
| ***B02C 21/00*** | (2006.01) |
| ***B07B 4/00*** | (2006.01) |
| ***B07B 7/00*** | (2006.01) |

(52) U.S. Cl. ..... 241/40; 241/65; 241/152

(58) Field of Classification Search ..... 241/40, 241/65, 152.1

See application file for complete search history.

(56) References Cited

U.S. PATENT DOCUMENTS

| | | | | | |
|---|---|---|---|---|---|
| 2,714,563 | A | * | 8/1955 | Poorman et al. | 427/446 |
| 2,851,223 | A | * | 9/1958 | Smith | 241/40 |
| 3,184,169 | A | * | 5/1965 | Friedman et al. | 241/40 |
| 3,482,786 | A | * | 12/1969 | Hogg | 241/52 |
| 4,222,527 | A | * | 9/1980 | Davis | 241/33 |
| 4,340,076 | A | * | 7/1982 | Weitzen | 137/13 |
| 4,691,866 | A | * | 9/1987 | Belk | 241/5 |
| 5,938,670 | A | * | 8/1999 | Keith et al. | 606/159 |

FOREIGN PATENT DOCUMENTS

| | | |
|---|---|---|
| EP | 0 850 690 A1 | 7/1998 |
| JP | 06-154639 | 6/1994 |
| JP | 07-088347 | 4/1995 |
| JP | 09-094473 | 4/1997 |

* cited by examiner

*Primary Examiner*—Bena Miller
(74) *Attorney, Agent, or Firm*—Patterson, Thuente, Skaar & Christensen, P.A.

(57) ABSTRACT

A muller for finely mulling a material to be processed is disclosed. The muller comprises a nozzle unit (10) including feed lines (12*a* and 12*b*) and hollow pipe lines (120*a* and 120*b*), a mulling unit (20) including a mulling head (22), and an input device (30) including a hopper (310) and a feeder (322). The muller finely mulls the material even if it has a relatively large particle size, and continuously feeds the material while mulling it in order to improve productivity. The muller conducts cold mulling of the material or maintains the temperature thereof by employing a cooling system to prevent the generation of heat due to inter-material collision as the material is transferred, or friction against the feed lines, thereby extending the lifespan of the muller. The muller requires no separate classifier by employing successively arranged mulling units (20*a* to 20*n*) to accomplish a high economical efficiency.

8 Claims, 5 Drawing Sheets

MULLER

TECHNICAL FIELD

The present invention relates to a muller, and more particularly to a muller for mixing a material to be processed in an air of high pressure and very low temperature, transferring the material mixed in the air, injecting the material using a nozzle at a very high pressure, and colliding the material against a mulling head, thereby finely mulling the material.

BACKGROUND ART

A mulling process is an easy process for manufacturing powder. Various mulling processes have been developed since ancient times. Powder manufacturing in the chemical industry, mining industry, and so on, has the purpose of enhancing a subsequent process efficiency using a large specific surface area of powder, mixing it with another material, or separating and recovering a useful component in a rock, rather than the purpose of obtaining powder itself. The mulling process is also applied to a living body.

Notwithstanding a long history, a mulling process has characteristics of a unit operation in that it requires consumption of a great amount of energy, and efficiency thereof is considerably low. Further, research into mulling has been considerably delayed compared to other research fields. Meanwhile, since a particle diameter distribution considerably affects development of new materials, a mulling process for achieving a desired grain distribution will become more important in the future.

As generally known, a solid body has cohesion energy. If the solid body is mulled and then a new surface is generated, the cohesion energy is converted to surface energy.

If the newly generated surface area is increased as mulling progresses, the surface energy is also increased. Then, if both become equal, the mulling process no longer progresses, thereby reaching the mulling limit.

Change of various physical properties due to such a mulling process is utilized in several fields.

That is, there are advantages, such as surface area increase, reactivity improvement, density increase, thermal capacity decrease, resolution improvement, viscosity change, adhesion force increase, reaction rate improvement, thinning, and so on, in chemistry and metal fields.

Further, there are advantages, such as transparency increase, gloss improvement, smoothness improvement, dry velocity improvement, freshness improvement, osmosis into fiber, and so on, in the pigment and cosmetics fields.

Further, there are advantages, such as surface area increase, treatment for being fit to drink, precipitation decrease, mixability improvement, uniformity of particle diameter, absorptiveness improvement, osmosis improvement, and so on, in the food and medicine fields.

According to usages of ultra fine particles having these advantages, they are variously used in new material fields such as ceramics, superconductors, and so on, the chemical field for petrochemicals, pigments, paint, resins, toner, and so on, the medicine field for cosmetics, injectable solutions, sugars, proteins, and so on, and the food field for calcium, vitamins, enzymes, food additives, and so on.

Various mullers have been developed due to the above stated advantages of the usages of the ultra fine particles.

Such a mulling process is a unit operation for obtaining fine particles by finely mulling solid material via mechanical methods. That is, the mulling process is one of the ancient unit operations in flour milling, pigment manufacturing, ore processing, and so on. Various kinds of mullers are known, and improvement of the muller has long been required.

Mullers may be generally classified according to particle size (mainly, product particle). That is, according to particle size, mulling may be broadly classified into crushing (several tens of an to between 10 and 19 cm), intermediate crushing (several cm to several tens of m m), comminuting (several cm to between 10 and 19 m m), and fine comminuting (several mm to several m m). Further, mullers may be classified by a power transmission mechanism (for example, reciprocating, rotary, link, and so on), and an actuating system (for example, compression, vibration, and so on).

Compression Type

A jaw crusher crushes a rock positioned between a fixed disc and a movable disc using a strong compression force. The crushing characteristics are different depending on whether an upper disc is the movable disc (in the input direction of a raw material) or a lower disc is the movable disc (in the output direction of a product). The jaw crusher is widely used as a first crusher. A gyratory crusher also conducts crushing by compression force. However, the gyratory crusher bites and crushes a rock by eccentrically rotating an inverted inner cone. The gyratory crusher requires a small quantity of raw material, having a higher continuity, and easily controls particle size compared to the jaw crusher. In a cone crusher, the inner cone is not eccentrically rotated. The cone crusher bites and crushes a material by rotation, and obtains a finer particle size.

High Velocity Rotation Type

A hammer crusher crushes a raw material by cutting, shearing, and collision by rotating a cutter or a hammer at a high velocity. Hammer crushers are widely used. The hammer crusher covers a considerably small mulling area by repeating a collision repulsion using a repulsion plate mounted to an inner wall of the crusher. Further, the hammer crusher conducts some classification by mounting a screen or a grid at a lower part of the crusher.

Among known crushers, there are jaw crushers, cone crushers, hammer crushers, cutter mills, shredders, hammer mills, roll crushers, edger runners, stamp mills, disc mills, pin mills, and so on.

Further, mulled material to be processed is recovered through particle size classification based on particle characteristics and particle diameter. Among known classification methods, there are wind power classification and hydraulic classification. Classifiers have also been variously devised.

However, according to the prior mullers, there have been problems in that pulverization is limited, system efficiency is low compared to input energy for pulverization, and productivity is lower since cleaning of the system is difficult.

Further, there have been defects in that increase of equipment and decrease of productivity both occur since pulverized material to be processed should be separated through a separate classifier.

DISCLOSURE OF INVENTION

Technical Problem

Therefore, the present invention has been made in view of the above problems, and it is an object of the present invention to provide a muller for enabling fine mulling of a material to be processed even if it has a relatively large particle size of several mm.

It is another object of the present invention to provide a muller for continuously feeding a material to be processed while mulling it, in order to improve productivity.

It is another object of the present invention to provide a muller for conducting cold mulling of a material to be processed or maintaining the temperature of the material by employing a cooling system to prevent the generation of heat due to inter-material collision as the material is transferred, or friction against feed lines, thereby extending the lifespan of the muller.

It is yet another object of the present invention to provide a muller which does not require a separate classifier by employing mulling units having the same structure in multiple levels according to fine particle size requirements in order to accomplish a high economical efficiency.

In accordance with the present invention, the above and other objects can be accomplished by the provision of a muller comprising a nozzle unit including a feed line and a hollow pipe line for surrounding the feed line and radially spaced from an outer surface of the feed line, the feed line having one side into which air of high pressure and very low temperature flows and the other side to which a nozzle is provided, a mulling unit connected to a free end of the nozzle at one side thereof, the mulling unit including a mulling head spaced from the nozzle on the same axis as the nozzle therein and a downwardly tapered, opened outlet, and an input device connected to the feed line at the middle of the nozzle unit, the input device including a hopper and a feeder for supplying a material to be processed. The material inputted from the input device is mixed with the air within the feed line and injected from the nozzle to collide with the mulling head.

DESCRIPTION OF DRAWINGS

The above and other objects, features and other advantages of the present invention will be more clearly understood from the following detailed description taken in conjunction with the accompanying drawings, in which.

BEST MODE

Figure 1:
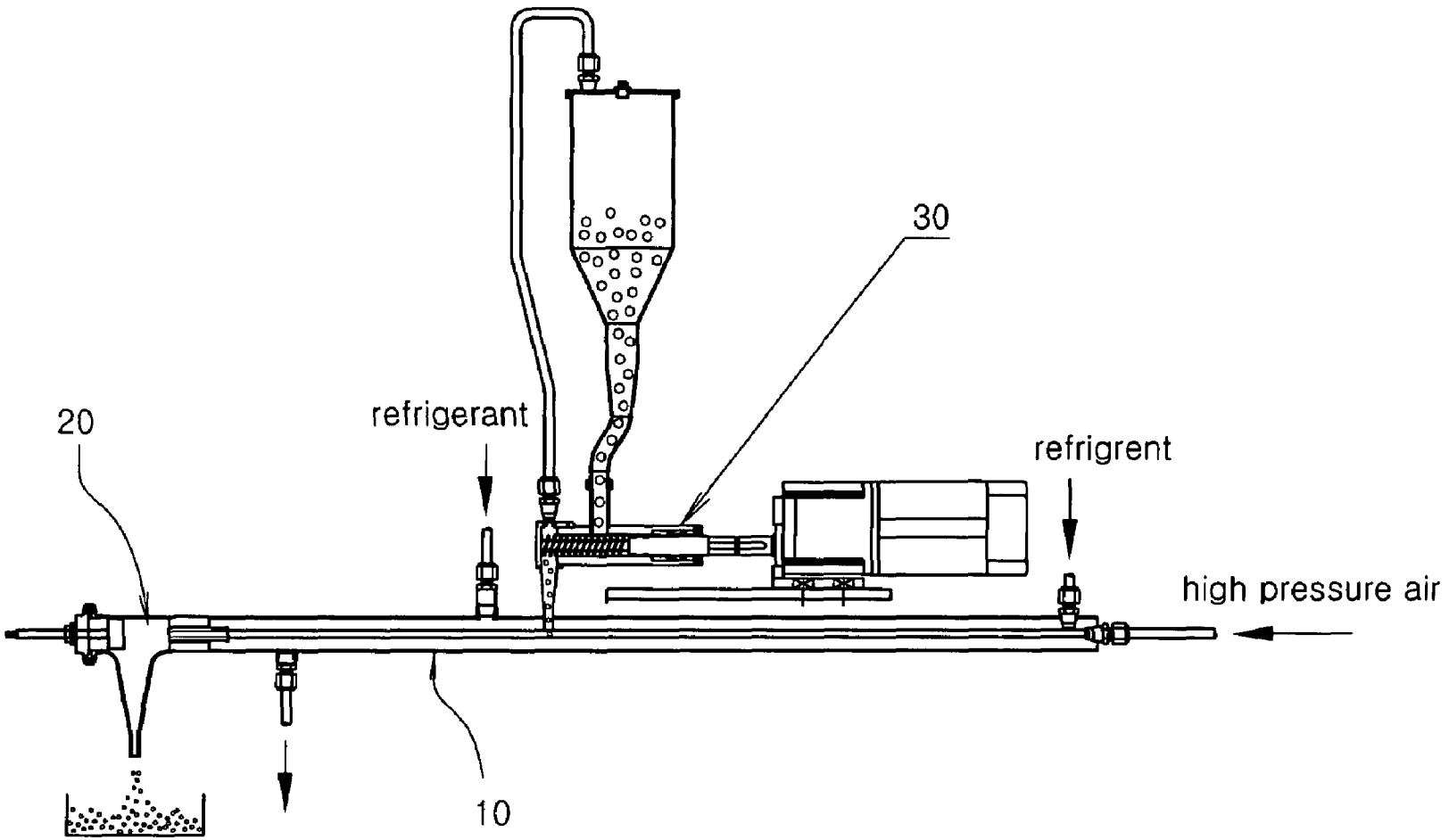
FIG. 1 is a schematic constitutional view showing a muller of the present invention.

FIG. 1 is a schematic constitutional view showing a muller of the present invention.

Referring to FIG. 1, a muller according to the present invention comprises a nozzle unit 10 for transferring and injecting a material to be processed, a mulling unit 20 for finely mulling the material, and an input device 30 for inputting the material. The nozzle unit 10 includes a feed line and a hollow pipe line for surrounding the feed line and radially spaced from an outer surface of the feed line. The feed line has one end into which air of high pressure and very low temperature flows and the other end at which a nozzle 11 is provided. Here, preferably, the air may have a temperature range of −20 to −80° C. The mulling unit 20 is connected to the nozzle at one end thereof. The mulling unit 20 includes a mulling head spaced from the nozzle on the same axis as the nozzle therein and a downwardly tapered, opened outlet. The input device 30 is connected to the feed line at the middle of the nozzle unit 10. The input device 30 includes a hopper and a feeder for supplying a material to be processed.

Figure 2:
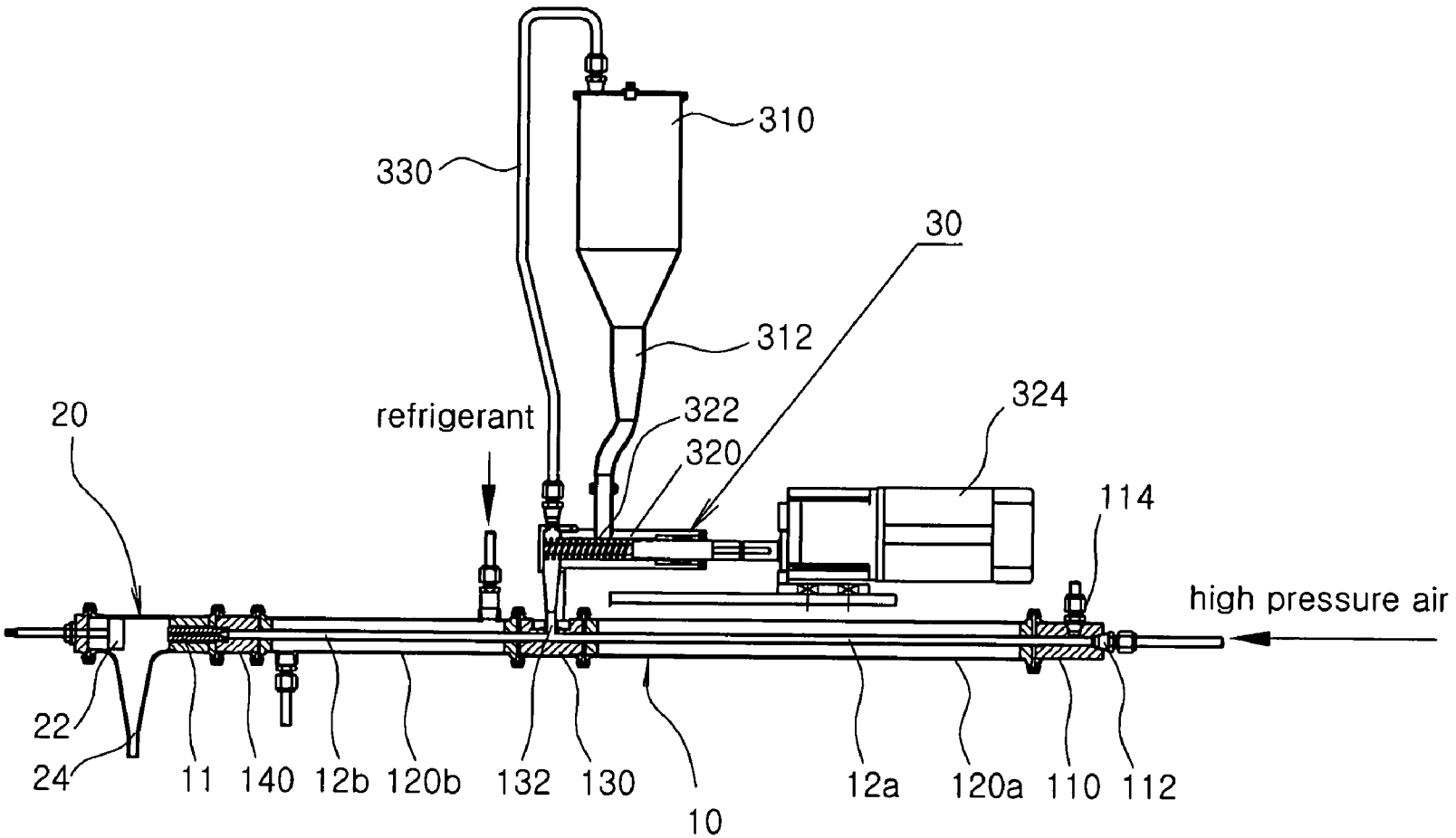
FIG. 2 is a sectional view showing a primary embodiment of the present invention.

FIG. 2 is a sectional view showing a primary embodiment of the present invention. Referring to FIG. 2, the feed line and the hollow pipe line shown in FIG. 1 include a first line 12*a* and a second feed line 12*b*, and a first hollow pipe line 120*a* and a second hollow pipe line 120*b*, respectively.

Specifically, the nozzle unit 10 further includes a first connector 110 connected to the first feed line 12*a* and the hollow pipe line 120*a*, respectively, a second connector 130 for respectively connecting the first feed line 12*a* and the first hollow pipe line 120*a* with the second feed line 12*b* and the second hollow pipe line 120*b*, respectively, and a third connector 140 for connecting the second feed line 12*b* and the second hollow pipe line 120*b* with the nozzle 11, respectively. Here, the first connector 110 has a flow path for communicating with the first feed line 12*a*, an inlet 112 for an inflow of the air, and a refrigerant inlet 114, respectively. The flow path of the first connector 110 communicates with the air inlet 112 and the refrigerant inlet 114, respectively. The second connector 130 has a flow path for communicating with the first feed line 12*a* and the second feed line 12*b*, respectively, and an inlet hole 132 for an inflow of the material supplied from the input device 30. The flow path of the second connector 130 communicates with the inlet hole 132. The third connector 140 has a flow path for communicating with the second feed line 12*b*. The flow path of the third connector 140 communicates with a flow path within the nozzle 11. The first connector 110, the second connector 130, the third connector 140, the first feed line 12*a*, the second feed line 12*b*, the first hollow pipe line 120*a*, the second hollow pipe line 120*b*, and the nozzle 11 are arranged as separate elements. Each element of the nozzle unit 10 is formed with a flange. Adjacent ones of the elements are connected through the facing flanges, while interposing a sealing gasket therebetween.

The first pipe line 120*a* and the second pipe line 120*b* have ports through which cooling nitrogen gas is introduced and discharged, respectively.

Meanwhile, the mulling unit 20 has a T-shaped hollow body, and an L-shaped flow path. The hollow body may be provided with the nozzle 11 to connect with the third connector 140. Preferably, the mulling head 22 is made of material with a very high hardness. The mulling head 22 faces an injection portion of the nozzle 11. Further, the mulling head 20 has the downwardly tapered, opened outlet 24.

The input device 30 loads crushed material to be processed. The input device 30 includes a hopper 310 having a large capacity and formed with an upper cover, and a feeder 320 supplying the material to be processed to one end of an outflow pipe 312 of the hopper to mix the material to be processed with the air in the feed line.

The feeder 320 includes a feed screw 322, and a feed motor 324 driving the feed screw 322.

The input device 30 further includes an inner pressure maintaining pipe line 330. The pipe line 330 equivalently maintains air pressure of the feed lines and inner pressure within the hopper 310 by connecting an upper part of the hopper 310 with the inlet hole 132.

The operational effects of the primary embodiment of the present invention will be given herein below.

Firstly, a material to be processed is crushed to a predetermined particle size. After opening the upper cover of the hopper 310, the crushed material is charged into the hopper 310. Here, the material has a particle size of about 5 mm or less, allowing it to pass through the nozzle diameter of about 6 mm. Of course, the nozzle diameter may be changed.

Crushing to a particle size of about 5 mm may be economically and easily provided by known equipment.

Once the above material to be processed is prepared, the air of high pressure and very low temperature is supplied to the air inlet 112 and the refrigerant inlet 114. Further, liquid nitrogen may be additionally supplied to them. Simultaneously, the feed motor 324 is driven to supply the material dropped by the feed screw 322 to the inlet hole 132 of the second connector by the screw feeder.

The supplied material is mixed with the air of high pressure and very low temperature within the feed line passed through the second connector 130, and it is then transferred to the nozzle 11. The material having passed through the nozzle 11 is injected at a very high pressure. Then, the material collides against the mulling head 22, and is then finely mulled.

Here, the mulling head 22 is required to be made of a material having a very high hardness. If the mulling head 22 is abraded due to use, it may be easily exchanged.

Specifically, after releasing the joint portion of the third connector 140, the mulling head 22 is removed. Further, the mulling head 22 has a screw fastening structure for adjusting a distance between the mulling head 22 and the front end of the nozzle 11.

The finely mulled material is discharged to the outlet 24 tapered and extended to the lower part of the mulling unit 20, and then it is recovered.

At this time, since a pressure difference is generated between the hopper connected to the feeder communicatively connected to the feed line of the high pressure and very low temperature air and the feed line, it is probable that the movement of the material will be blocked. Thus, the pipe line 330 is connected between the hopper and the feed line to offset the pressure difference and equalize the pressures therein.

Meanwhile, a temperature increase may be generated within the feed line due to frictional heat according to the supply of the material to be processed and the high pressure air. The temperature increase causes the equipment to be rapidly abraded. Further, the temperature increase lowers the mulling efficiency.

Thus, according to the present invention, a small quantity of liquid nitrogen serving as a refrigerant is supplied through the inlet 114, to which the high pressure and very low temperature air is supplied, to the first connector 110. Then, the liquid nitrogen is vaporized and mixed with the air. As a result, the temperature increase of the feed line is prevented, and a cold mulling process can be realized. Further, since double cooling is realized by circulating the nitrogen gas within the pipe line 120, dew condensation due to the temperature increase is prevented. As a result, the mulling efficiency is maximized.

Here, it has been determined through experimentation that a straight injection method has a higher mulling efficiency than a diffusion injection method.

Figure 3:
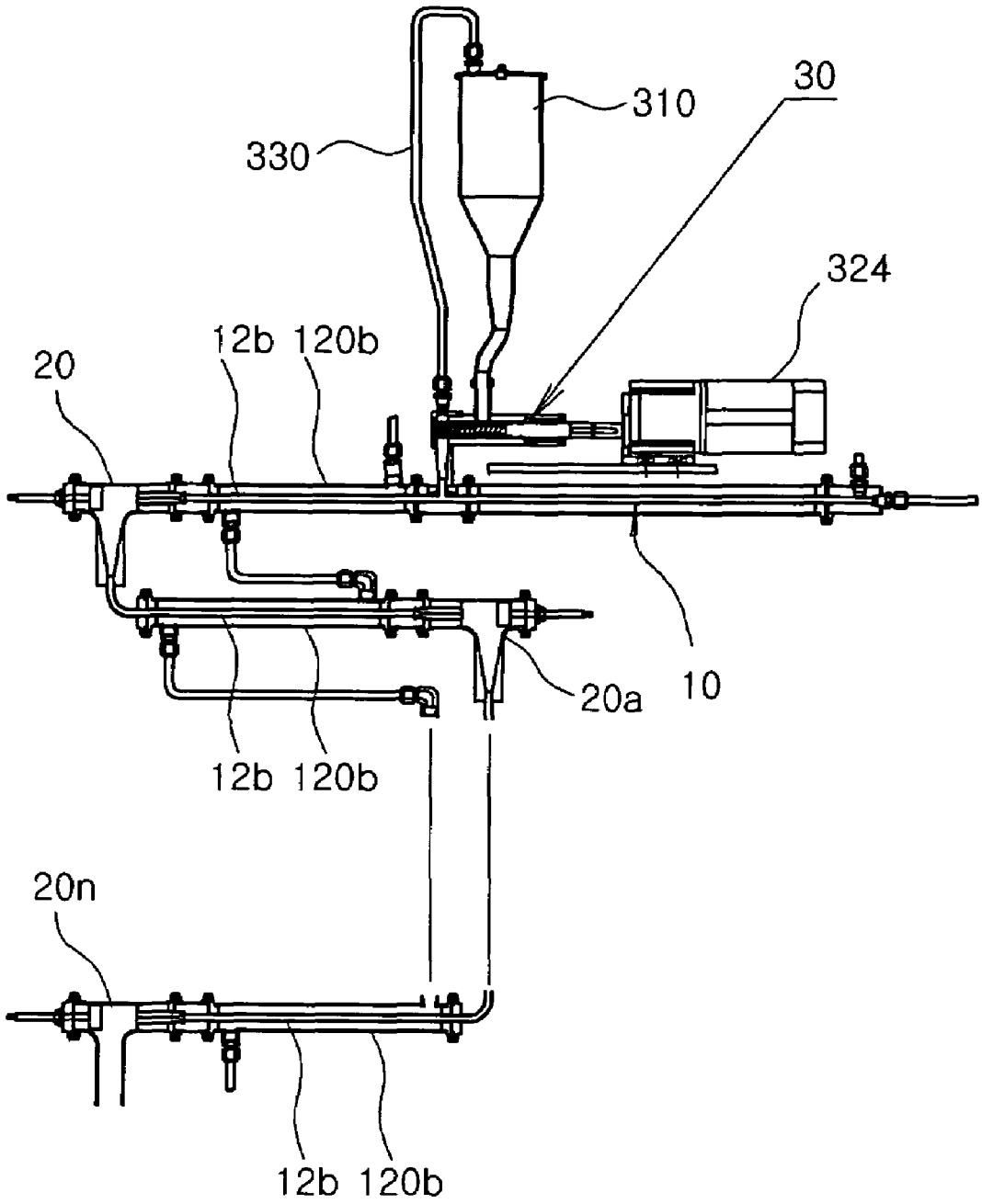
FIG. 3 is a sectional view showing a modified embodiment of the invention shown in FIG. 2.

Next, with reference to FIG. 3, a modified embodiment of the present invention will be given herein below.

The modified embodiment provides additional nozzle units and additional mulling units 20*a* to 20*n* to the primary embodiment shown in FIG. 2.

Here, the additional nozzle units include feed lines 12*b*, hollow pipe lines 120*b*, and connectors 140 having nozzles with more reduced nozzle diameters.

The mulling units 20*a* to 20*n* are successively connected in such a manner that one mulling unit is connected to another mulling unit arranged upstream thereof.

According to the modified embodiment, the material firstly mulled by one nozzle is transferred to another mulling unit arranged downstream thereof by high pressure air, and is then secondly mulled while passing through a more reduced nozzle diameter of a nozzle adjacent to another mulling unit. Thus, when nozzles of nozzle units respectively having gradually reduced nozzle diameters are successively connected, a final material discharged through the last nozzle has a considerably small particle size.

Next, another embodiment of the input device of the present invention will be given herein below.

Figure 4:
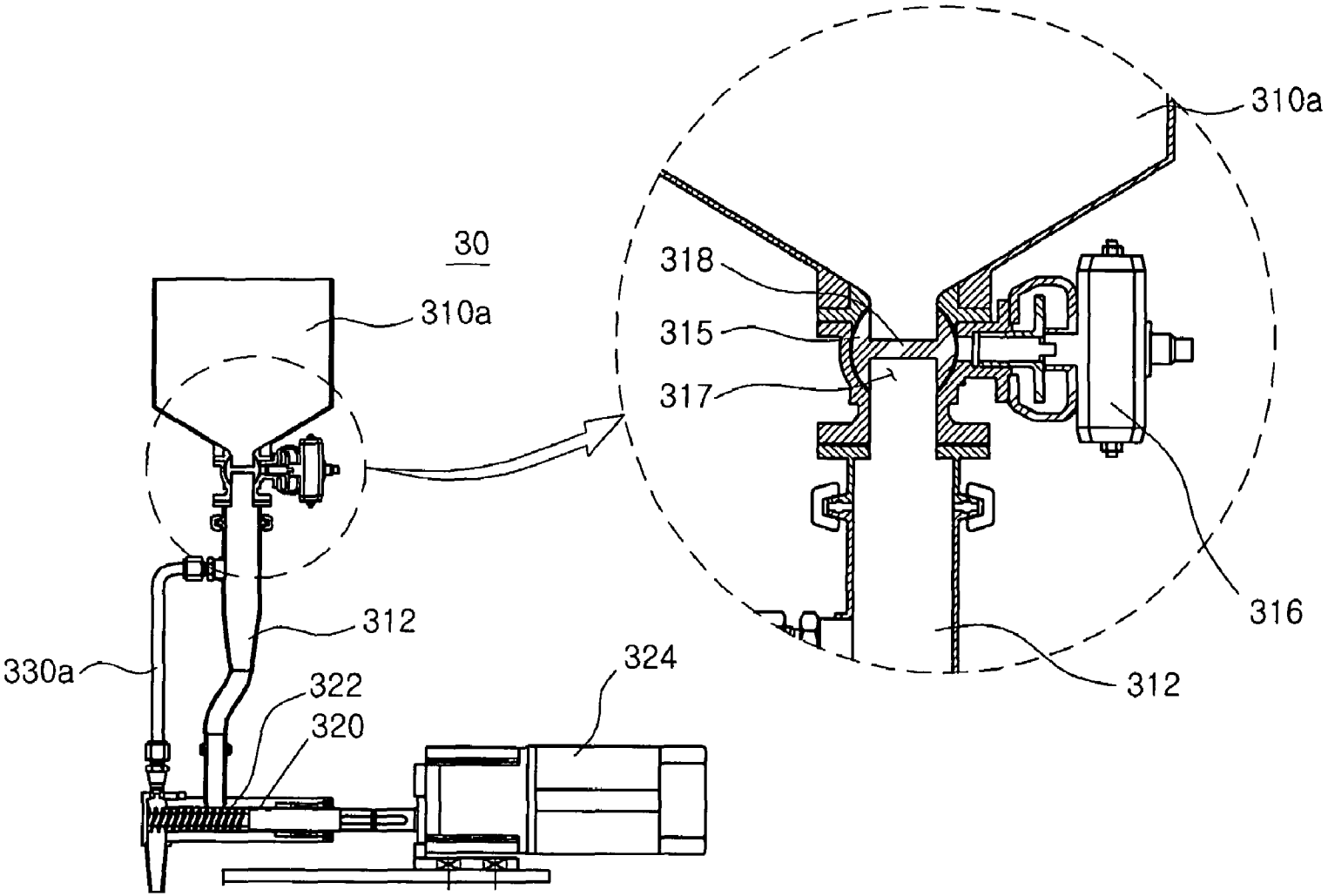
FIG. 4 is a sectional view showing another embodiment of a material to be processed input device of the present invention.

Referring to FIG. 4, an open type hopper 310*a* for successively inputting a material to be processed is provided. The hopper 310*a* is formed at a lower part thereof with a ball valve 315. The ball valve 314 is rotated by a servo motor 316, and upper and lower through holes 317 thereof are blocked by a partition 318. An inner pressure maintaining pipe line 330*a* is connected between the feeder 320 and a lower part of the ball valve 315.

According to the above input device, it is advantageous that a material to be processed, which is exhausted according to the progress of the mulling process, is continuously inputted.

Specifically, according to the hopper of the input device according to the primary embodiment, since the hopper is closed by the sealed upper cover, it is impossible to continuously input the material to the hopper. However, according to the input device shown in FIG. 4, since the upper part of the hopper 310*a* is always opened, the material may be constantly supplemented.

The material received in the upper through hole is rotated downward and supplied to the feed screw 322, when the ball valve 315 having the upper and lower through holes divided by the partition 318 is rotated by 180° by the intermittently driven servo motor 316. At this time, high pressure within the feed line shuts off reverse inflow of the material into the hopper through the partition 318. As a result, the material may be repeatedly supplied.

Here, if the ball valve is rotated upward by the high pressure air filled within the lower through hole 318, since the high pressure within the hole is rapidly expanded through the lower part of the hopper, the material loaded with a high density maintained by the force of gravity and atmospheric pressure, is rapidly dispersed, and the density of the material is lowered. As a result, inflow of the material into the through hole is smoothly conducted.

Of course, a passage for the material passing through the ball valve is provided with a pipe line 33*a* to maintain the same pressure as the inner pressure of the feed line. As a result, smooth flow of the material is secured.

Thus, the present invention provides a muller for preventing the high pressure within the nozzle unit 10 from adversely discharging to the outside, while improving operation efficiency of the hopper due to continuous supply of the material.

Figure 5:
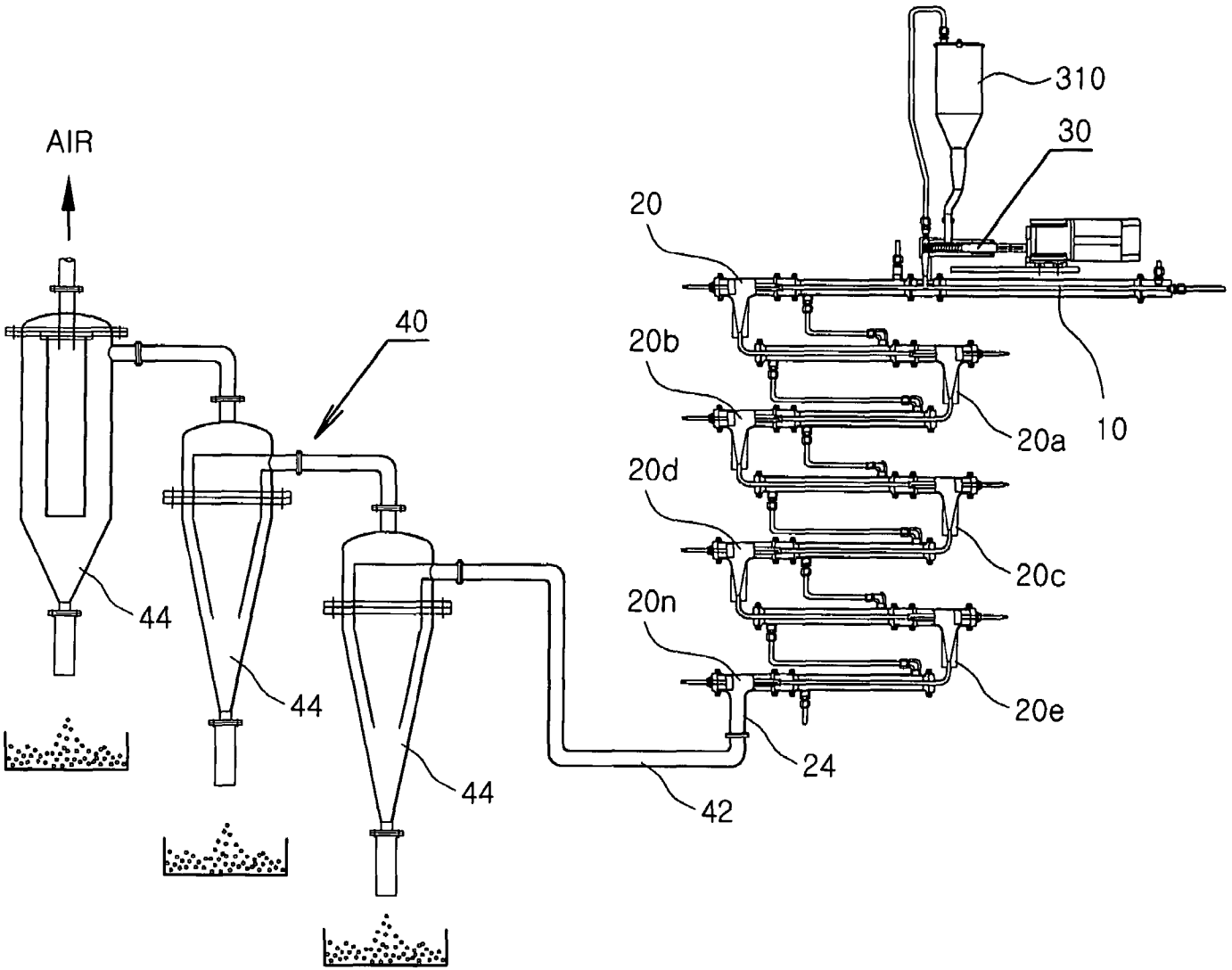
FIG. 5 is a constitutional view showing installation of additional recovery devices for recovering mulled material.

A recovery system for recovering the mulled material is shown in FIG. 5. The recovery system includes a plurality of material separators 44.

Specifically, one material separator 44 for conforming a cyclone process is connected to an outlet 24 of the last mulling unit 20*n* by a pipe line 42. The separator 44 may be connected to at least one separator additionally arranged downstream thereof so as to confirm multistage cyclone processes.

The mulled material passing through the pipe line 42 passes through the separator 44. At this time, the material is discharged downward due to a centrifugal force, decompression, and reversion. Then, the material is successively processed while passing through the next separators. As a result, the completely mulled material is recovered by separating the material from the air.

Meanwhile, in the case of successively connecting the mulling units, circulation of liquid nitrogen may be employed by respectively connecting supply lines of the liquid nitrogen to following nozzles units so as to achieve insulation of the mulling unit and the feed line from the outside air and cooling of inner heat generated from them.

Further, the feed line transferring the air with the high pressure and very low temperature may be provided at its inner surface with vortex rifling or inside thereof with a vortex coil to increase mulling pressure due to vortex air generated within the feed line. This vortex generation serves to enhance mulling efficiency by increasing injection velocity of the nozzle.

INDUSTRIAL APPLICABILITY

As apparent from the above description, the present invention provides a muller for enabling fine mulling of a material to be processed even if it has a relatively large particle size of several mm. That is, the fine mulling is accomplished even if preceding processes such as crushing before inputting into the muller are not precisely controlled. Thus, since burden for preceding process of the material is lightened, high economical efficiency and high productivity may be expected. Further, the present invention provides a muller for successively feeding a material to be processed while finely mulling the material, in order to improve productivity. Further, the present invention provides a muller for enabling cold mulling of a material to be processed or maintaining the temperature of the material by employing a cooling system to prevent the generation of heat due to inter-material collision as the material is transferred, or friction of the material against an internal wall of a feed line, thereby extending the lifespan of the muller. Especially, since cold mulling is progressed according to a property of a material to be processed, mulling efficiency is increased. Further, the present invention provides a muller that does not require a separate classifier by employing mulling units having the same structure in multiple levels according to fine particle size requirements. Thus, equipment expense is considerably reduced. Further, since ultra fine mulling and concentrated particle size nay be secured, practical application of the material and product quality may be considerably improved.

Further, the present invention provides a muller which prevents mixing of pre-worked and post-worked material generated upon obtaining mulled material via several devices and processes in the prior art, since the muller of the present invention is able to work the material to a desired particle size finally selected in a single-line by successively reducing a nozzle diameter to mull the material to gradually reduced particle sizes.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A muller comprising:

a nozzle unit including a feed line and a hollow pipe line for surrounding the feed line and radially spaced from an outer surface of the feed line, the feed line having one end into which air of high pressure and very low temperature flows and the other end at which a nozzle is provided;

a mulling unit connected to the nozzle at one end thereof, the mulling unit including a mulling head spaced from the nozzle on the same axis as the nozzle therein and a downwardly tapered, opened outlet; and an input device connected to the feed line at the middle of the nozzle unit, the input device including a hopper and a feeder for supplying a material to be processed, whereby the material inputted from the input device is mixed with the air within the feed line and injected from the nozzle to collide with the mulling heads, wherein the feed line and the hollow pipe line include a first feed line and a second feed line, and a first hollow pipe line and a second hollow pipe line, respectively, wherein the nozzle unit further includes:

a first connector connected to the first feed line and the first hollow pipe line, respectively, the first connector having a flow path for communicating with the first feed line, an inlet for an inflow of the air, and a refrigerant inlet, respectively, the flow path of the first connector communicating with the air inlet and the refrigerant inlet, respectively, a second connector for connecting the first feed line and the first hollow pipe line with the second feed line and the second hollow pipe line, respectively, the second connector having a flow path for communicating with the first feed line and the second feed line, and an inlet hole for an inflow of the material supplied from the input device, respectively, the flow path of the second connector communicating with the inlet hole, and a third connector for connecting the second feed line and the second hollow pipe line with the nozzle, respectively, the third connector having a flow path for communicating with the second feed line, the flow path of the third connector communicating with a flow path within the nozzle, whereby the first connector, the second connector, the third connector, the first feed line, the second feed line, the first hollow pipe line, the second hollow pipe line, and the nozzle are arranged as separate elements, each element of the nozzle unit being formed with a flange, adjacent ones of the elements being connected through the facing flanges, while interposing a sealing gasket therebetween.

2. The muller as set forth in claim 1, wherein the mulling unit further includes a T-shaped hollow body and an L-shaped flow path, wherein the hollow body is connected with the third connector of the nozzle unit while having the nozzle at one end of the flow path thereof, the mulling head with a very high hardness facing an injection portion of the nozzle.

3. The muller as set forth in claim 1, wherein the input device loads a crushed material, the input device including the hopper with a high capacity formed with an upper cover and the feeder for supplying the material to an outflow pipe of the hopper to mix the material with the air in the feed line, the feeder including a feed screw and a feed motor for driving the feed screw, the input device further including a pipe line for connecting an upper part of the hopper with an inlet hole of the nozzle unit to equivalently maintain inner pressure within the hopper and air pressure within the feed line.

4. The muller as set forth in claim 1, wherein the muller further comprises additional nozzle units including feed lines, hollow pipe lines, and connectors connected with nozzles respectively having reduced nozzle diameters, and additional mulling units connected with the additional nozzle units, whereby the additional mulling units are successively connected in such a manner that one mulling unit is connected to another mulling unit arranged upstream thereof

5. The muller as set forth in claim 4, wherein each of the nozzle diameters is gradually reduced.

6. The muller as set forth in claim 1, wherein the input device loads a crushed material, the input device including the hopper which is an open type hopper for successively inputting the material, and the feeder for supplying the material to an outflow pipe of the hopper to mix the material with the air in the feed line, the feeder including a feed screw and a feed motor for driving the feed screw, the hopper being provided at a lower part thereof with a ball valve, the ball valve being rotated by a servo motor, the ball valve having upper and lower through holes blocked by a partition, the feeder and the lower portion of the ball valve being connected by a pipe line for maintaining their inner pressures.

7. The muller as set forth in claim 1 or 4, wherein the muller further comprises a material separator for conforming a cyclone process, the separator being connected to the outlet of the mulling unit by a pipe line, wherein the separator is connected to at least one separator additionally arranged downstream thereof so as to conform multistage cyclone processes.

8. The muller as set forth in claim 1, wherein the hollow pipe line of the nozzle unit is provided with ports through which refrigerant is introduced and discharged for cooling circulation.

* * * * *